United States Patent [19]

Cairns et al.

[11] 4,221,455

[45] Sep. 9, 1980

[54] FUSE TERMINAL BLOCK WITH ALTERNATIVE MEANS FOR CONNECTION TO FUSE BLADE CONTACTS

[75] Inventors: Thomas M. Cairns, Birmingham; John H. Dewar, Grosse Ile; Emmons F. Sumner, Ann Arbor, all of Mich.

[73] Assignee: Ford Motor Company, Dearborn, Mich.

[21] Appl. No.: 16,474

[22] Filed: Mar. 1, 1979

[51] Int. Cl.[3] ..... H01R 13/645

[52] U.S. Cl. ..... 339/186 M; 339/147 R; 339/258 F

[58] Field of Search ..... 339/147 R, 147 P, 126 R, 339/184 R, 184 M, 186 R, 186 M, 219 F, 198 G, 198 K, 198 S, 198 GH, 217 S, 134, 113 R, 113 B, 66 R, 66 M, 258 F, 262 F, 154 R, 154 A; 337/198; 361/426, 430-431, 357, 360, 347-348

[56] References Cited

U.S. PATENT DOCUMENTS

| | | | |
|---|---|---|---|
| 2,831,087 | 4/1958 | Sundt . | |
| 2,851,671 | 9/1958 | Luce . | |
| 2,955,178 | 10/1960 | Lander et al. . | |
| 3,060,293 | 10/1962 | Lapidus . | |
| 3,253,252 | 5/1966 | Piperato et al. . | |
| 3,341,745 | 9/1967 | Munro . | |
| 3,775,723 | 11/1973 | Mamrick et al. . | |
| 3,775,724 | 11/1973 | Mamrick et al. . | |
| 3,848,951 | 11/1974 | Michaels et al. . | |
| 3,851,224 | 11/1974 | Ege . | |
| 3,909,767 | 9/1975 | Williamson et al. | 337/264 |
| 4,097,109 | 6/1978 | Cross | 339/258 F X |

*Primary Examiner*—Howard N. Goldberg
*Assistant Examiner*—Eugene F. Desmond
*Attorney, Agent, or Firm*—Peter Abolins; Clifford L. Sadler

[57] ABSTRACT

This specification discloses an automobile fuse terminal block for receiving fuses and electrical connections to various electrical components of the automobile. The terminal block has a passage for receiving the blade contacts of a fuse. Electrical contact to the fuse blade can be accomplished either from the front or rear of the terminal block. First, a fuse holder positioned in the passage can contact the blade contacts of a fuse. Access to the fuse holder can be both from the front and the rear of the terminal block thus providing for contact to the fuse blade both from the front and the rear without the need for removing the fuse. Second, a connector adapter entering an access from the back of the terminal block extends sufficiently into the access to provide mating with the blade connector of the fuse.

8 Claims, 12 Drawing Figures

FIG. 1.
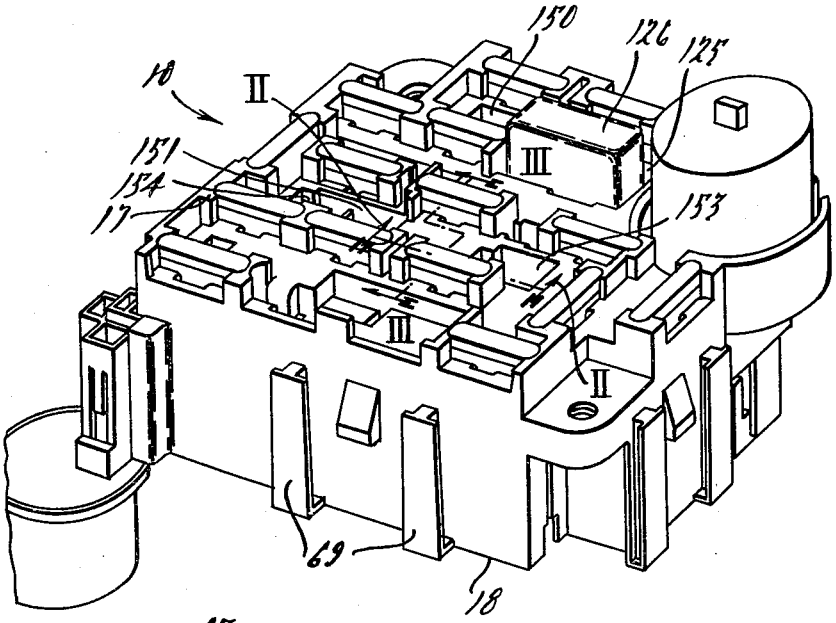
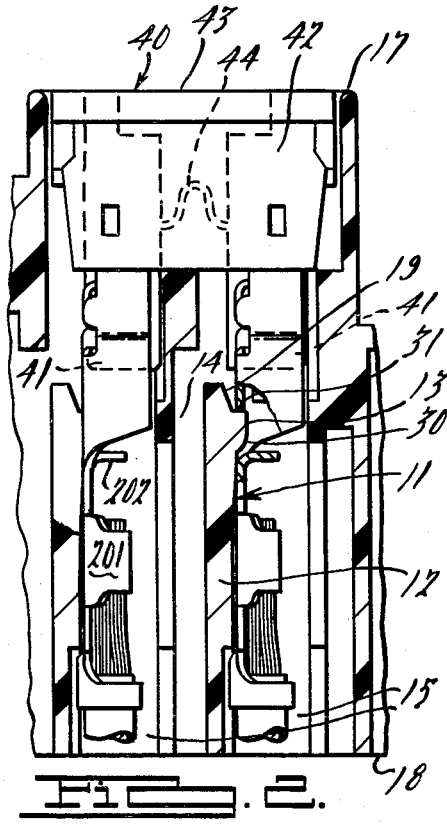
FIG. 2.
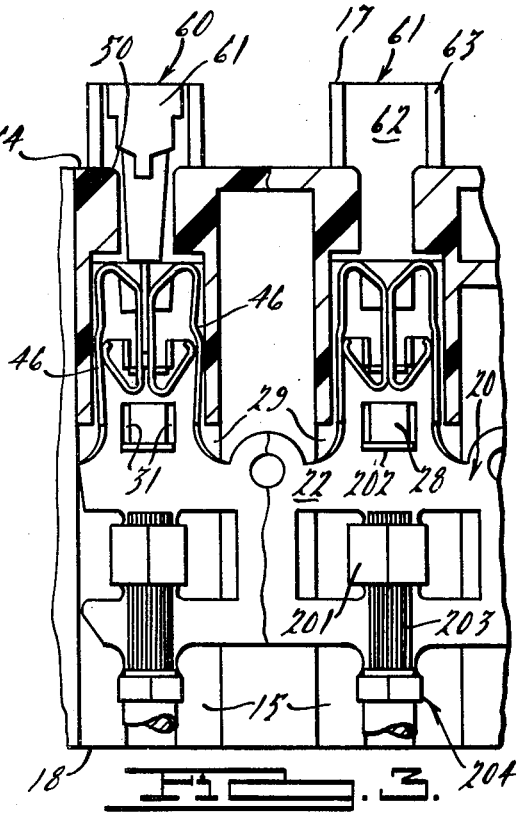
FIG. 3.

FUSE TERMINAL BLOCK WITH ALTERNATIVE MEANS FOR CONNECTION TO FUSE BLADE CONTACTS

BACKGROUND OF THE INVENTION (1) Field of the Invention

This invention relates to electrical connectors and, more particularly, to a terminal block which removably secures various connections.

(2) Prior Art

Automobiles typically have a fuse terminal block which is mounted adjacent the instrument panel or forward fire wall to provide a means for securing fuses and for providing connections to various electrical components of an automobile such as headlights, horns, power seats, power windows and numerous other electrical options which can be customer selected on automobiles.

It is particularly desirable that connection can be made to a fuse blade in a rapid and easy manner. It is desirable that some connections be of a temporary nature for testing and that some connections be permanent for attaching an electrical accessory to a fuse.

For example, in one known system shown in U.S. Pat. No. 4,097,109, a first pair of opposing prongs of a fuse holder can connect to the blade contact of a fuse and a second pair of opposing prongs can connect to an accessory electrical connector. The accessory electrical connector is inserted into the fuse block from the front into the second pair of prongs of the fuse holder. As a result, it is not possible to achieve a releasable connection to the blade of a fuse from the rear of the terminal block. Further, such connections from the front can be placed no closer together than adjacent pairs of prongs. These are some of the problems this invention overcomes.

SUMMARY OF THE INVENTION

This invention recognizes that electrical connection to the blade contact of a fuse can be made from both the front and rear of a terminal block while the fuse remains positioned in the terminal block.

For access to the fuse blade contact from the front and the rear of the terminal block, a fuse holder, mounted within the terminal block, connects to the blade of the fuse and extends laterally away from the fuse blade. The lateral extension of the fuse holder extends into a cavity in which is slidably received an accessory connector to the terminal block. Such connection to the fuse holder can be either from the front or the rear of the terminal block. This lateral extension can be particularly advantageous to form a temporary connection for such purposes as testing.

Additionally, from the rear, a connector adapter can enter an access in the terminal block and extend sufficiently into the access to provide mating with the blade contact of the fuse without need for an intermediate fuse holder. The connector adapter includes a spring clip with two prongs for receiving therebetween the blade contact of the fuse. The connector adapter further can include a polarizing means mating with a polarizing means in the passage so that the connector adapter is inserted properly.

The connector adapter and accessory connector can further include slotted guide arms for receiving a locking ramp extending from the terminal block thereby locking the connector adapter and accessory connector within the terminal block and providing a stable support for the fuse blade connector. The guide arms are accessible from the side opposing the insertion side of the terminal block for deflection away from the locking ramp so that the connector adapter and accessory connector can be removed.

BRIEF DESCRIPTION OF THE DRAWINGS

FIG. 1 is a perspective view of a terminal block in accordance with an embodiment of this invention;

FIG. 2 is a section view taken along line II—II of FIG. 1;

FIG. 3 is a section view taken along line III—III of FIG. 1;

DETAILED DESCRIPTION OF THE INVENTION

Figure 4:
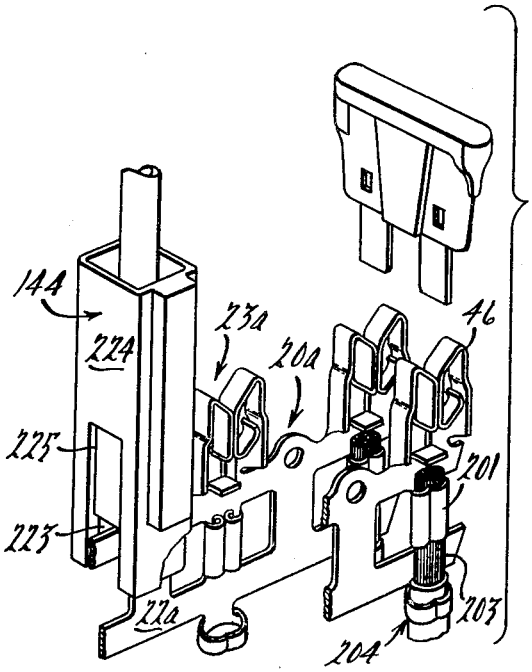
FIG. 4 is a perspective view of a fuse positioned for connection with two fuse holders, one of the fuse holders being connected from the top, or front, by an accessory test connector.
Figure 6:
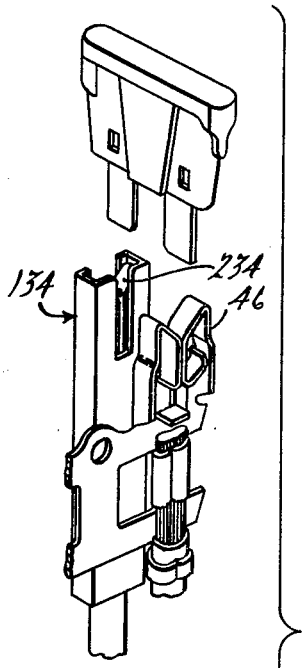
FIG. 6 is a perspective view of a fuse with one blade positioned above a fuse holder and another blade positioned above a connector adapter.

Referring to FIG. 1, a terminal block 10 has the general shape of a rectangular solid with a plurality of passages 15 (FIGS. 2 and 3) extending therethrough between a front (or top) surface 17 and a rear (or bottom) surface 18. At least some of passages 15 from top surface 17 of terminal block 10 are designed to receive one of a pair of spaced blade contacts 41 of a fuse 40. Fuse 40 is advantageously a miniature plug-in fuse similar to that described in U.S. Pat. No. 3,909,767 issued Sept. 30, 1975 and assigned to Littelfuse, Inc. At least some of passages 15 are accessible from bottom surface 18 of terminal block 10 and are adapted to receive a fuse holder 20 as shown in FIGS. 2, 3 and 4. Further various accessory connections can be made from the bottom of terminal block 10 to fuse holder 20 or, in some cases, directly to blade contacts 41 of fuse 40 (FIG. 6).

Fuse holder 20 has an elongated bus bar 22 having a plurality of crosswise spring clips 23, each having a pair of prongs 21 (FIG. 3). Thus viewed from spring clips 23, fuse holder 20 has a lateral portion extending between adjacent spring clips 23. Fuse holder 20 further has a pair of attaching prongs 201 for grasping a conducting wire 203 of an electrical lead 204 thus establishing an electrical connection between fuse holder 20 and electrical lead 27. Prongs 21 have an outside portion 24, an intermediate portion 25 and an end portion 26. Between outside portion 24 and intermediate portion 25 there is a fold or bend. Similarly, there is another fold or bend between intermediate portion 25 and end portion 26. Accordingly, spring clip 23 comprises two prongs 21 which are folded back on themselves twice so that the end portions 26 of each prong 21 bear resiliently against the outside portions 24 and the intermediate portions 25 of the two prongs 21 bear against each other. In use, a blade contact 41 of fuse 40 is held resiliently between intermediate portions 25 of the two prongs 21. Fuse holder 20 also includes an opening 28 associated adjacent each spring clip 23 which acts in cooperation with a portion of terminal block 10 to secure fuse holder 20 in terminal block 10.

Along passage 15 there extends an elongated resilient finger 11 having an elongated body 12 at the end of which there is a protrusion 13. Behind resilient finger 11, in a direction opposite from protrusion 13, is a stop plate 14 (FIG. 2). Stop plate 14 is spaced from and generally parallel to resilient finger 11 so that a bending movement of resilient finger 11 in the direction of stop plate 14 is limited. However, stop plate 14 is sufficiently spaced from resilient finger so that protrusion 13 can be deflected to the side of passage 15 thereby providing a clear path for the insertion of fuse holder 20 into passage 15.

Resilient finger 11 has an end portion 19 (see FIG. 2) extending above protrusion 13 for providing a segment of finger 11 which can be engaged for bending finger 11. When undeflected, resilient finger 11 extends sufficiently into passage 15 so that end portion 19 is accessible from top surface 17 through passage 15. For example, a small screwdriver can be inserted into the top opening of passage 15 and extend down to engage end portion 19 and move finger 11 toward stop plate 14. Elongated body 12 of finger 11 forms a portion of the wall of passage 15 and has a longitudinal slit on each side separating body 12 from the remainder of the wall of passage 15. Protrusion 13 is shaped with a curved ramp 30 facing bottom surface 18 so that fuse holder 20 can pass over the ramp and a locking ledge 31 (FIG. 2) which extends through opening 28 in fuse holder 20 and prevents withdrawal of fuse holder 20 from passage 15 (FIG. 3). The cross section of protrusion 13 parallel to opening 28 is approximately the same as the open area of opening 28 in fuse holder 20 so that there is a secure fit holding fuse holder 20 in terminal block 10.

Figure 11:
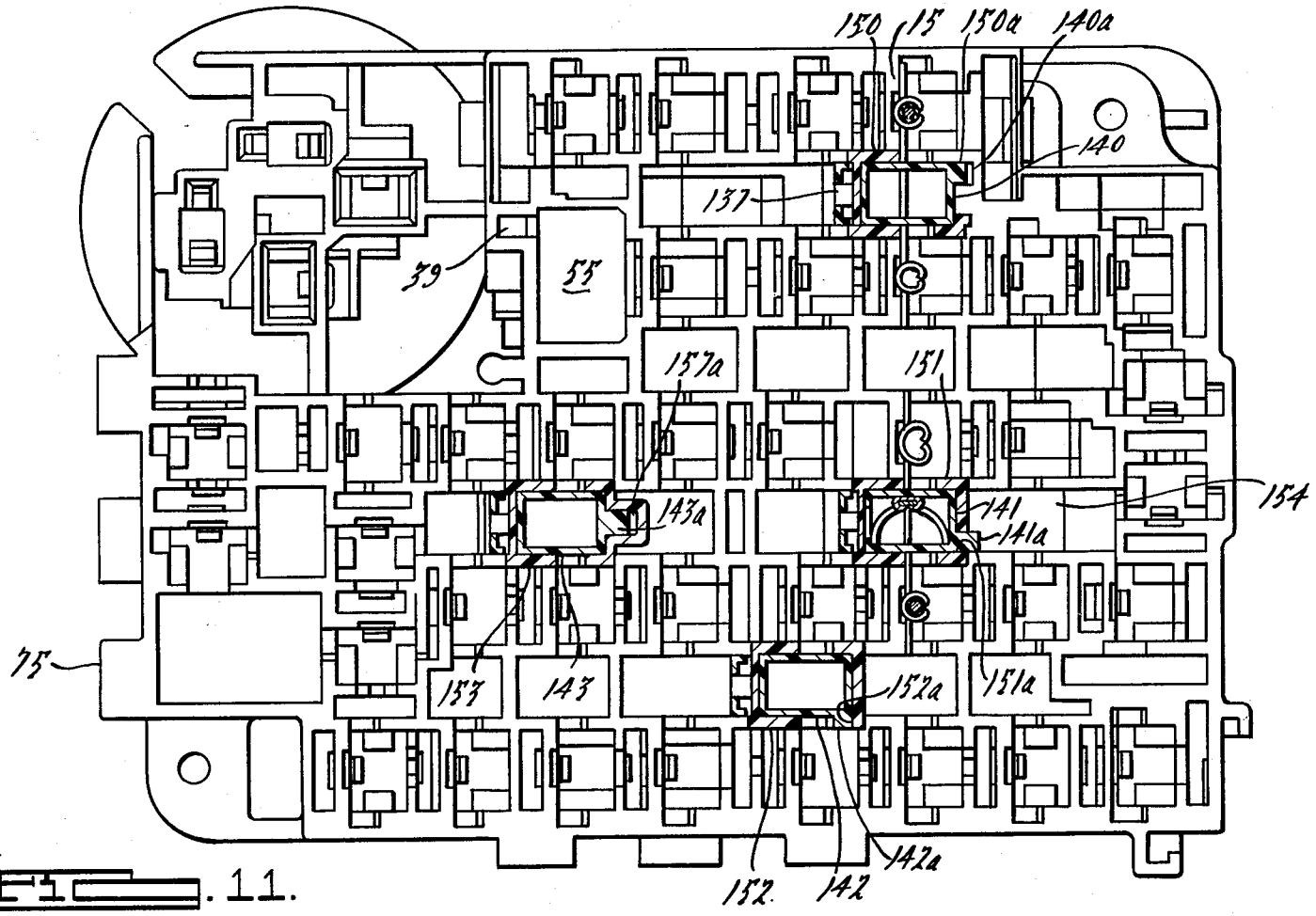
FIG. 11 is a section view along line XI—XI of FIG. 10 with the raised walls identifying accessory receiving cavities and the accessory connectors shown in cross section and the remainder of the terminal block as a bottom plan view.

Referring to FIG. 3, a pair of passages 15 are shown side by side. Similarly, fuse holder 20 includes a pair of side by side spring clips 23 with a laterally connecting bus bar 22. The adjacent walls of the two passages 15 each have a slot 29 to pass bus bar 22. A typical cross section of passage 15 has a rectangular shape with two long sides and two short sides (FIG. 11). Resilient finger 11 is defined in one of the long sides by a pair of spaced, parallel slots 31 (FIG. 3).

Referring to FIG. 2, a pair of passages 15 are positioned so that they receive the two blade contacts 41 of a single fuse 40 in different fuse holders 20. The resilient finger of one passage deflects back toward the wall opposing the resilient finger of the other passage. In effect, the stop means for one resilient finger doubles as a portion of the wall for another passage.

Fuse 40 is a relatively small, flat element which includes a flat sheet metal stamp 42 partially situated within a plastic housing 43. Stamping 42 includes a fuse element 44 and blade contact 41 which are a pair of laterally spaced protruding contact elements to be received between prongs 21 of a spring clip 23 which is part of fuse holder 20 (FIG. 2). As is known, fusing a component of the automotive electrical system typically involves placing a fuse in series with a power source and the electrical component.

Additional description of the above described fuse terminal block assembly is found in the following copending applications filed on even date herewith, the disclosures of which are hereby incorporated by reference: Title of I—Terminal Block With Electrical Connection Means With Connector Location Wall And Locking Finger, Ser. No. 016,469. Title of IV—Terminal Block With Fuse Guards And Identification Surface, Ser. No. 016,473. Title of VI—Fuse Holder With Insertion Ramp, Ser. No. 016,579.

Figure 10:
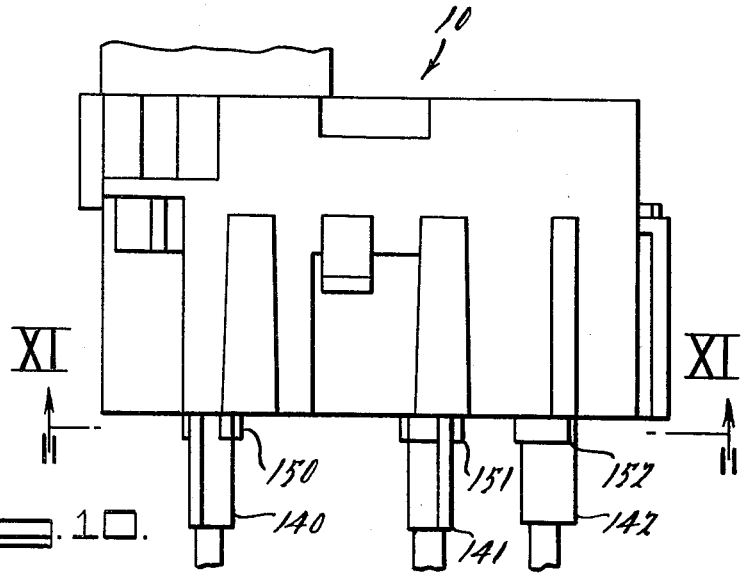
FIG. 10 is a side view of a terminal block in accordance with an embodiment of this invention with accessory connectors inserted from the rear.

This invention is directed toward achieving an electrical connection to blade contact 41 of fuse 40. A lateral extension from spring clips 23 (e.g., bus bar 22) can be contacted from either the front or the rear of terminal block 10. Such access is possible between adjacent spring clips 23 within any of a plurality of cavities extending into terminal block 10 (FIGS. 10 and 11). The cavities can extend completely through terminal block 10 so that the lateral extension of fuse holder 20 is accessible from either the front or rear of terminal block 10. Further, blade contact 41 can be directly contacted by a connector adapter 34 extending into an access 55 in the rear of terminal block 10 (FIG. 11).

An accessory connector 140 is adapted to be received within a cavity (raised wall) 150 in terminal block 10, an accessory connector 141 is adapted to be received within a cavity (raised wall) 151 in terminal block 10, an accessory connector 142 is adapted to be received within a cavity (raised wall) 152 in terminal block 10, and an accessory connector 143 is adapted to be received in a cavity (raised wall) 153 in terminal block 10 (FIGS. 10 and 11). Accessory connectors 140 through 143 have the same cross section configuration as the cavities 150 through 153, respectively, and are best uniquely associated with the cavities so that only one of accessory connectors 140 through 143 can fit in any of the cavities 150 through 153. Each accessory connector 140 through 143 has a longitudinal ridge denoted by ridge **140*a*, 141*a*, 142*a* and 143*a*, respectively. the ridges are positioned at various angles extending out from the accessory connector. Similarly, each cavity 150 through 153 has a slot 150*a*, 151*a*, 152*a* and 153*a***, respectively, for receiving the ridge associated with the terminal connector. The slots and ridges are polarizing means which insure the correct orientation of the accessory connector within the cavity and the correct association of each terminal connector with the cavity.

Figure 12:
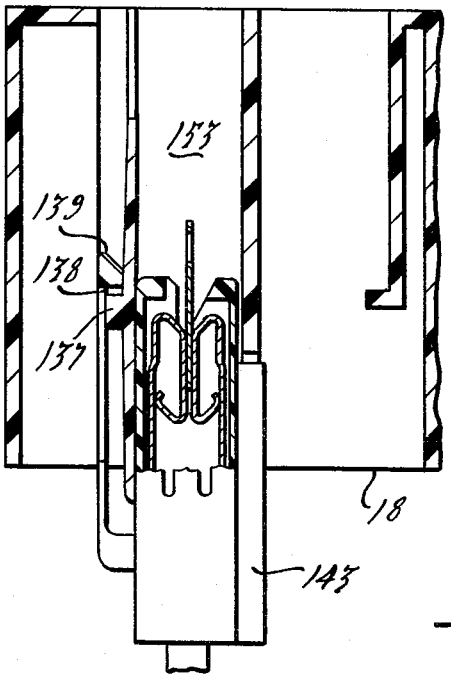
FIG. 12 is a section view showing an accessory connector locked in an accessory receiving cavity in accordance with an embodiment of this invention.

A typical accessory connector 140 through 143 includes a guide arm 139 spaced from, and generally parallel to, the longitudinal length of the accessory connector. The area between guide arm 139 and the main body of the accessory connector slides over a locking ramp 137 (FIGS. 11 and 12) of terminal block 10 and has a slot 138 for receiving locking ramp 137 thereby locking the accessory connector to terminal block 10 (FIG. 12). Cavity 153 is generally symmetric about a central plane through terminal block 10 so that accessory connector 143 can enter either to top or bottom of cavity 153 and have guide arm 139 engage locking ramp 137.

Cavities 150, 151 and 153 extend completely through terminal block 10 from front surface 17 to rear surface 18. In this particular embodiment, cavity 152 is accessible only from the rear of terminal block 10. Accordingly, accessory connectors 140, 141 and 143 can be inserted into terminal block 10 from front surface 17 as well as rear surface 18. The bus bar 22 of fuse holder 20 in any cavity provides the same electrical connection point whether approached from the top or the bottom.

A temporary connection is particularly advantageous for performing various tests which may be necessary is provided by a non-locking terminal connection 144 (FIG. 6) received by a cavity 154 (FIG. 1) from either the front or rear. Terminal connector 144 includes a spring clip 223, similar to spring clip 23, which attaches to the laterally extending portion of bus bar 22 of fuse holder 20. There is sufficient pressure applied by spring clip 223 so that terminal connector 144 is temporarily secured to fuse holder 20. However, non-locking terminal connector 144 is not secured in any locking manner to fuse holder 20 so that it can be simply pushed in or pulled out to make or break a connection.

Connector adapter 34 (FIG. 6) inserts from the rear of terminal block 10 into an access 55 (FIG. 11) which extends from the rear of terminal block 10 to blade contact 41 of fuse 40. As a result, fuse holder 20 is not necessary and there can be a direct connection from the rear to blade contact 41 of fuse 40. Connector adapter 34 has a spring clip 234 similar to spring clip 23. A housing 36 for spring clip 234 is used to securely position spring clip 234 within terminal block 10. Housing 36 includes a guide arm which receives a locking ramp extending from terminal block 10 to lock housing 36 within terminal block 10. The guide arm is movable so that it can be removed from the locking ramp and housing 36 removed from terminal block 10. Connector adapter 34 has a polarizing ridge which acts in cooperation with a polarizing recess 39 (FIG. 11) in terminal block 10 which acts to orient connector adapter 34 with respect to terminal block 10 and thus the blade connector 41 of fuse 40.

Referring to FIG. 4, a fuse 40 with spaced fuse contact blades 41 is positioned above a pair of fuse holders 20 each having one spring clip 23 aligned with a blade contact 41. Rearwardmost fuse holder **20*a* has non-locking terminal connector 144 extending down over a portion of bus bar 22*a* which extends laterally from spring clip 23*a*. Terminal connector 144 includes spring clip 223 which extends over bus bar 22*a*. Terminal connector 144 also includes a tube like housing member 224 which has a generally rectangular cross section and is positioned over spring clip 223. Opposing sides of housing member 224 have slots 225 which receive a portion of bus bar 22*a* which extend between spring clip 223**.

Figure 5:
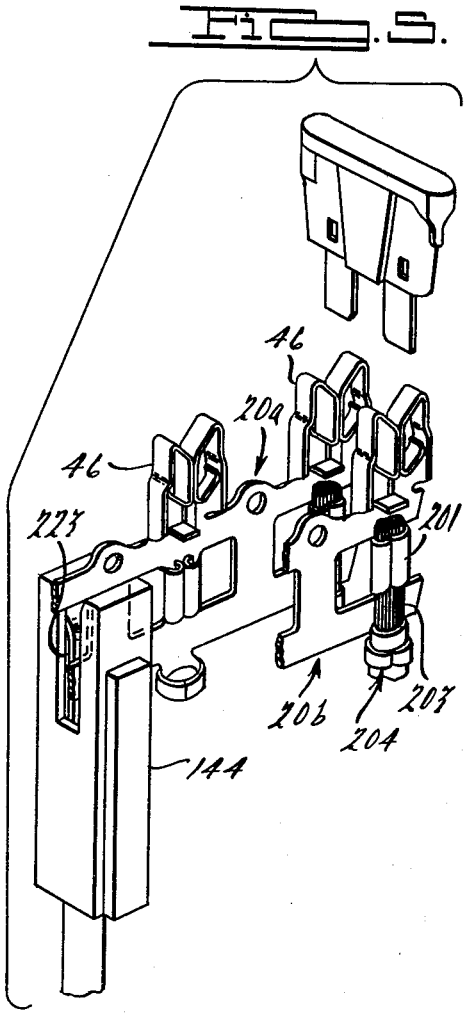
FIG. 5 is a perspective view similar to FIG. 4 with the exception that one of the fuse holders is connected from the bottom, or rear, with an accessory test connector.

Referring to FIG. 5, two fuse holders **20*a* and 20*b* are again shown with a fuse 40 positioned to be received by the spring clips of the fuse holders. However, instead of having non-locking terminal connector 144 entering from above, terminal connector 144 enters from the rear or below. For clarity, the remainder of terminal block 10 including cavity 154 which receives terminal connector 144, is not shown. Accessory connectors 140, 141 and 143 connect in much the same manner as terminal connector 144**.

Referring to FIG. 6, a fuse 40 has one blade contact 41 positioned above a spring clip 23 of fuse holder 20 and another blade contact 41 positioned above connector adapter 34 which has spring clip 234 for receiving blade contact 41. Connector adapter 34 extends into the rear of terminal block 10 all the way to the blade contact 41. Connector adapter 34 is longer than accessory connector 140 because it must extend all the way from the rear of terminal block 10 to blade contact 41 without an intervening fuse holder 20.

Figure 7:
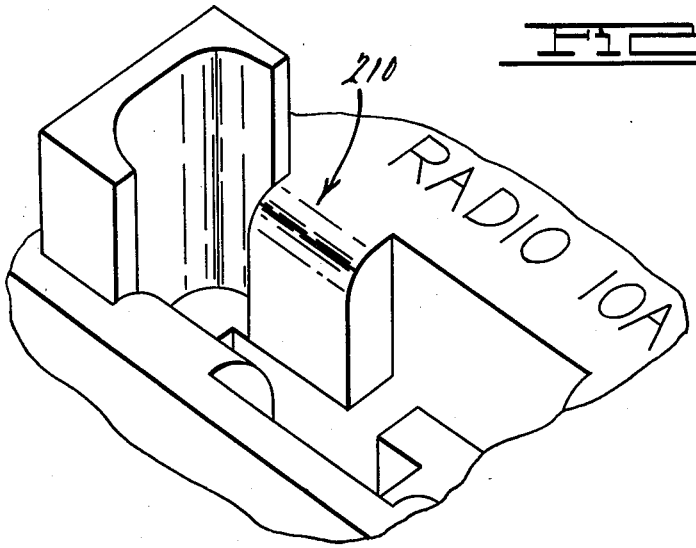
FIGS. 7, 8 and 9 are a partial perspective view, a full perspective view and top plan view, respectively, of a connector body for permitting use of either a fuse or a circuit breaker with the terminal block.
Figure 8:
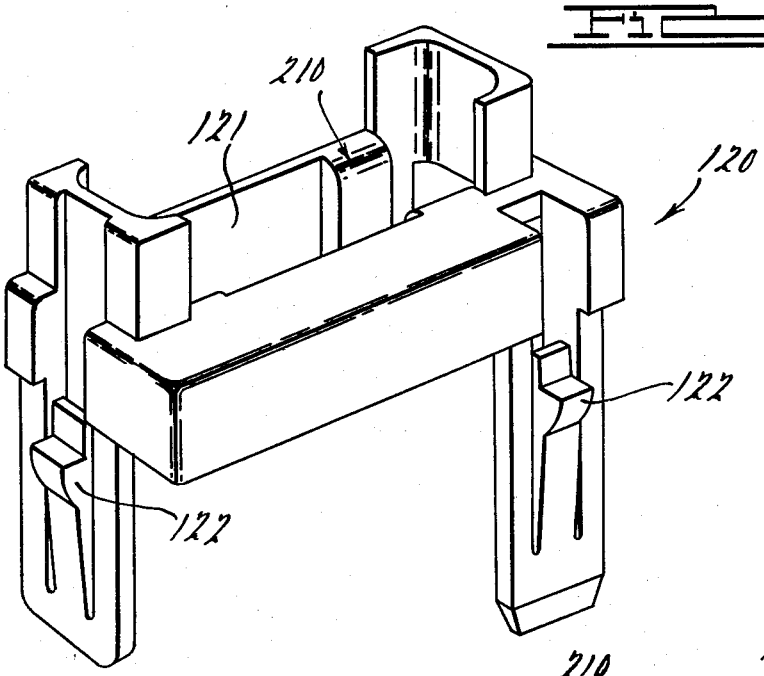
Figure 9:
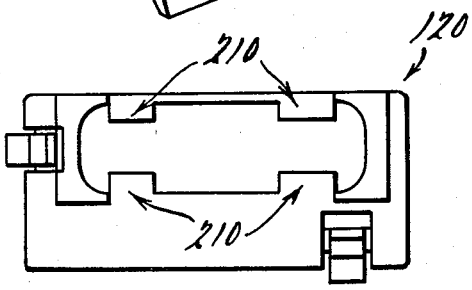

Referring to FIGS. 7, 8 and 9, a connector body 120 can be positioned in a socket or cavity 125 to adapt that cavity from receiving a circuit breaker 126 (FIG. 1) to receiving a fuse 40. As a result, the same fuse holders 20 in terminal block 10 can be used with either a circuit breaker or a fuse. This, of course, means that the blade contacts of the circuit breaker can also be contacted from both the front and rear of terminal block 10.

Referring to FIGS. 3 and 5, outside portion 24 of each prong 21 of spring clip 23 has a hip 46 which gives spring clip 23 a smaller width at the top than the bottom. The two different widths permit a relatively snug fit between the bottom of spring clip 23 and the sides of passage 15 while allowing sufficient clearance between the top of spring clip 23 and the sides of passage 15 to facilitate positioning of a blade contact 41 between the two prongs 21 of spring clip 23.

Various modifications and variations will no doubt occur to those skilled in the various arts to which this invention pertains. For example, the size of the connectors may be varied from that disclosed herein. These and all other variations which basically rely on the teachings through which this disclosure has advanced the art are properly considered within the scope of this invention.

We claim:

1. A fuse terminal block assembly including a terminal block for providing connection between an automotive electrical system and fuses for fusing components of the automotive electrical system, said terminal block having a front and a rear;

said fuses having a pair of blade contacts which are positioned within said terminal block so that said blade contacts can be electrically accessed for releasable connection and disconnection from both the front and rear of said terminal block while said fuse remains in a secured position within said terminal block;

said fuse terminal block assembly having a fuse holder, a cavity and an accessory connector whereby access to a blade contact of a fuse is provided through an intermediate fuse holder connection; and said fuse holder extending into said cavity and said cavity in said terminal block extending through said terminal block between the front and the rear of said terminal block for receiving said accessory connector thereby providing access to the same area of said fuse holder from both the front and the rear of said terminal block through a single cavity.

2. A fuse terminal block assembly as recited in claim 1 further comprising a passage, said fuse holder including a spring clip having a pair of opposing prongs for receiving therebetween said fuse blade contact and having a lateral portion extending laterally away from said prongs;

said terminal block including said passage for receiving said spring clip and said blade contact, and including said cavity for laterally receiving said lateral extension of said fuse holder;

said cavity in said terminal block providing access to said lateral extension from both the front and the rear of said terminal block; and said passage in said terminal block extending through said terminal block between the front and the rear of said terminal block thereby being adapted to receive said spring clip from the rear and said blade contact from the front of said terminal block.

3. A fuse terminal block assembly as recited in claim 2 wherein:

said terminal block has a plurality of cavities, each one of said cavities being uniquely associated with one lateral extension of a fuse holder; and each of said cavities having a unique cross section configuration and polarization means so that a given accessory connector having a mating cross section and polarization means can enter only one of said plurality of cavities thus insuring that the accessory connector makes the same electrical contact whether inserted from the front or the rear of said terminal block.

4. A fuse terminal block assembly as recited in claim 3 wherein said terminal block includes a locking ramp associated with each of said cavities and each of said accessory connectors receivable within said cavities has a guide arm with an opening for receiving said locking ramp thereby locking said accessory connector within said terminal block.

5. A fuse terminal block assembly as recited in claim 4 wherein there are three cavities with rear connector openings for receiving accessory connectors in the rear of said terminal block and there are three mirror image openings, aligned with said rear connector openings in the front of said terminal block, the plane of symmetry for said cavities passing through substantially the center of said terminal block generally parallel to the front and the rear of said terminal block; and each of said cavities having a relationship between said polarization means and said locking ramp which is a mirror image when viewed from the rear as when viewed from the front.

6. A fuse terminal block assembly as recited in claim 2 further comprising a connector body removable from said terminal block for providing a socket in said terminal sufficiently large to receive a circuit breaker thereby providing for connection between the circuit breaker having a pair of blade contacts and said automotive electrical system so that the blade contacts of said circuit breaker can be positioned in the same location as the pair of blade contacts from one of said fuses.

7. A fuse terminal block assembly as recited in claim 1 further comprising a connector adapter for coupling an electrical connection to said terminal block and an access in said terminal block for receiving said connector adapter whereby rear access to one of said fuse blade contacts is provided by said access, said access extending from the rear of said terminal block to the front of said terminal block so that said fuse blade contact can be received from the front of said terminal block;

said connector adapter entering said access from the rear of said terminal block and extending sufficiently into said access to provide mating with said blade contact of said fuse;

said connector adapter having therein a spring clip with two prongs for receiving therebetween the blade contact of said fuse; and said connector adapter including coupling means for providing a releasable locking connection between said terminal block and said connector adapter.

8. A fuse terminal block assembly as recited in claim 2 wherein said spring clip includes a pair of prongs each having an outside portion, an intermediate portion, and an end portion, there being a fold or bend between the outside portion and the intermediate portion and between the intermediate portion and end portion so that the two prongs are folded back on themselves twice, the end portion of each prong bears resiliently against the outside portion, and the intermediate portions of the two prongs bear against each other; said outside portion having a hip means so that the width of said spring clip is less at the top than at the bottom thus permitting a relatively snug fit between the bottom of said spring clip and said passage and permitting sufficient clearance between the top of said spring clip and said passage to facilitate positioning of said fuse blade contact between said prongs when said spring clip is positioned in said passage.

* * * * *